US008199064B2

(12) United States Patent
Semonov et al.

(10) Patent No.: US 8,199,064 B2
(45) Date of Patent: Jun. 12, 2012

(54) OMNI DIRECTIONAL BROADBAND COPLANAR ANTENNA ELEMENT

(75) Inventors: Kostyantyn Semonov, Irvine, CA (US); Alexander Rabinovich, Cypress, CA (US); Bill Vassilakis, Orange, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 526 days.

(21) Appl. No.: 12/287,661

(22) Filed: Oct. 10, 2008

(65) Prior Publication Data

US 2009/0096698 A1 Apr. 16, 2009

Related U.S. Application Data

(60) Provisional application No. 60/998,662, filed on Oct. 12, 2007.

(51) Int. Cl.
*H01Q 19/10* (2006.01)

(52) U.S. Cl. ..... 343/818

(58) Field of Classification Search ..... 343/818, 343/893, 833, 834, 795, 872
See application file for complete search history.

(56) References Cited

U.S. PATENT DOCUMENTS

| | | | | |
|---|---|---|---|---|
| 4,812,855 | A | 3/1989 | Coe et al. | |
| 6,067,053 | A | 5/2000 | Runyon et al. | |
| 6,670,923 | B1 | 12/2003 | Kadambi et al. | |
| 6,741,219 | B2 | 5/2004 | Shor | |
| 6,747,605 | B2 | 6/2004 | Lebaric et al. | |
| 6,859,176 | B2 | 2/2005 | Choi | |
| 7,132,989 | B1 * | 11/2006 | Poilasne | 343/745 |
| 7,215,285 | B2 | 5/2007 | Song et al. | |
| 7,224,315 | B2 | 5/2007 | Tsai et al. | |
| 7,274,339 | B2 | 9/2007 | Wu et al. | |
| 7,696,943 | B2 * | 4/2010 | Chiang | 343/833 |
| 7,764,245 | B2 | 7/2010 | Loyet | |
| 7,986,280 | B2 | 7/2011 | Semonov | |
| 2003/0218571 | A1 | 11/2003 | Yoon et al. | |
| 2003/0231138 | A1 * | 12/2003 | Weinstein | 343/795 |
| 2004/0061652 | A1 * | 4/2004 | Ishihara et al. | 343/752 |
| 2004/0090371 | A1 * | 5/2004 | Rossman | 343/700 MS |
| 2004/0125031 | A1 | 7/2004 | Jo et al. | |
| 2004/0207562 | A1 * | 10/2004 | Schadler | 343/770 |
| 2006/0232492 | A1 * | 10/2006 | Sawatani | 343/893 |
| 2006/0290573 | A1 | 12/2006 | Puente Baliarda et al. | |
| 2008/0169993 | A1 * | 7/2008 | Matsuzawa et al. | 343/814 |
| 2009/0079653 | A1 | 3/2009 | Semonov et al. | |
| 2009/0096698 | A1 * | 4/2009 | Semonov et al. | 343/795 |

OTHER PUBLICATIONS

PCT International Search Report and Written Opinion of the International Search Authority for Application No. PCT/US 08/11655 dated Dec. 10, 2008.
Office Action dated Apr. 28, 2011 from U.S. Appl. No. 12/212,533.
PCT International Search Report and Written Opinion of the International Search Authority for Application No. PCT/US08/10851 dated Nov. 25, 2008.

* cited by examiner

*Primary Examiner* — Huedung Mancuso
(74) *Attorney, Agent, or Firm* — OC Patent Law Group

(57) ABSTRACT

The present invention provides an omni-directional antenna element configuration having a compensated radiation pattern. Broadband antenna elements are coplanarly disposed on a suitable planar dielectric material. A single element omni-directional antenna comprises a pair of balanced fed radiating microstrip elements symmetrically disposed about the centerline of a balanced signal feed network. Additionally, a pair of pattern augmentation rods are positioned on each side of and proximate to the planar dielectric material running longitudinally to the centerline axis of a balanced feed network. Disposed proximate to each radiating element are partially coplanar, frequency bandwidth expanding microstrip lines. The combination of radiating elements together with pattern augmentation rods provides a broad bandwidth omni-directional radiating element suitable for use in multi-element antenna arrays.

8 Claims, 10 Drawing Sheets

OMNI DIRECTIONAL BROADBAND COPLANAR ANTENNA ELEMENT

RELATED APPLICATION INFORMATION

The present application claims priority under 35 USC section 119(e) to U.S. provisional patent application Ser. No. 60/998,662 filed Oct. 12, 2007, the disclosure of which is incorporated herein by reference in its entirety.

BACKGROUND OF THE INVENTION

1. Field of the Invention

The present invention relates in general to radio communication systems and components. More particularly the invention is directed to antenna elements and antenna arrays for radio communication systems.

2. Description of the Prior Art and Related Background Information

Modern wireless antenna implementations generally include a plurality of radiating elements that may be arranged to provide a desired radiated (and received) signal beamwidth and azimuth scan angle. For an omni-directional antenna it is desirable to achieve a near uniform beamwidth that exhibits a minimum variation over 360 degrees of coverage. Differing from highly directional antennas an omni-directional antenna beamwidth is preferably nearly constant in azimuth. Such antennas provide equal signal coverage about them which is useful in certain wireless applications. However it is difficult to maintain a desired broad frequency bandwidth and also provide an omni-directional beamwidth.

Accordingly a need exists for an antenna design which expands the useful frequency bandwidth of an antenna element while providing a nearly uniform omni-directional radiation pattern.

SUMMARY OF THE INVENTION

In a first aspect the present invention provides an omni-directional antenna comprising a first radiating element and a second radiating element oriented in generally opposite directions, a first parasitic radiating element configured between the first and second radiating elements and spaced apart therefrom in a first direction, and a second parasitic radiating element configured between the first and second radiating elements and spaced apart therefrom in a second direction generally opposite to the first direction.

In a preferred embodiment the omni-directional antenna further comprises a generally planar dielectric support structure. The first radiating element and second radiating element are planar dipole radiating elements configured on the planar dielectric support structure. The first and second parasitic radiating elements are configured on opposite sides of the dielectric support structure and spaced apart therefrom. The first and second parasitic radiating elements are preferably spaced an equidistance from respective opposite sides of the dielectric support structure. The first and second parasitic radiating elements may comprise elongated conductive rods. In one embodiment the omni-directional antenna may further comprise third and fourth parasitic radiating elements, configured between the first and second radiating elements and spaced apart therefrom in the first and second directions, respectively. In such an embodiment, the first, second, third and fourth parasitic radiating elements may comprise generally parallel elongated conductive rods. More specifically, in a coordinate system defined such that the first and second directions correspond to opposite directions along a y axis, the first radiating element and second radiating element are oriented in opposite directions along an x axis, and a z axis is defined perpendicular to the x y plane, the generally parallel elongated conductive rods have a length dimension extending in the z direction. The first and third and second and fourth parasitic radiating elements are then preferably aligned along the y direction and symmetrically configured on opposite sides of the x axis. In an alternative configuration the first and third and second and fourth parasitic radiating elements may be respectively aligned along directions parallel to the x axis and symmetrically configured on opposite sides of the x axis.

In another aspect the present invention provides an omni-directional antenna structure comprising a radome, a planar dielectric substrate configured within the radome and having first and second dipole radiating elements configured thereon symmetrically disposed about a feed line, first and second conductive elements configured within the radome symmetrically arranged on opposite sides of the planar dielectric substrate and spaced apart therefrom, and a support structure holding the first and second conductive elements in that configuration.

In a preferred embodiment of the omni-directional antenna structure the first and second conductive elements may comprise conductive rods extending parallel to the feed line. The support structure may comprise first and second nonconductive support plates mounted within the radome and coupled to opposite ends of the conductive rods. The omni-directional antenna structure may further comprise third and fourth conductive elements configured within the radome and symmetrically arranged on opposite sides of the planar dielectric substrate and spaced apart therefrom.

In another aspect the present invention provides an omni-directional antenna structure comprising a radome, a planar dielectric substrate configured within the radome and having first and second dipole radiating elements configured thereon symmetrically disposed about a feed line and oriented to provide a radiation beam pattern in opposite azimuth directions, and means configured within the radome for parasitically augmenting the radiation beam pattern to provide a substantially omni-directional azimuth radiation pattern.

In a preferred embodiment of the omni-directional antenna structure the means for parasitically augmenting the radiation beam pattern comprises symmetrically configured conductive elements on opposite sides of the dielectric substrate. As one example, the antenna operational radio frequency (RF) may be approximately 3.30 GHz to 3.80 GHz. The conductive elements may be spaced apart from the dielectric substrate by a distance of about 360 to 440 mils. The conductive elements may comprise conductive rods of diameter between about 160 to 250 mils. The conductive elements may comprise dual rods configured on each side of the dielectric substrate.

Further features and advantages of the present invention will be appreciated from the following detailed description of the invention.

DETAILED DESCRIPTION OF THE INVENTION

Figure 1:
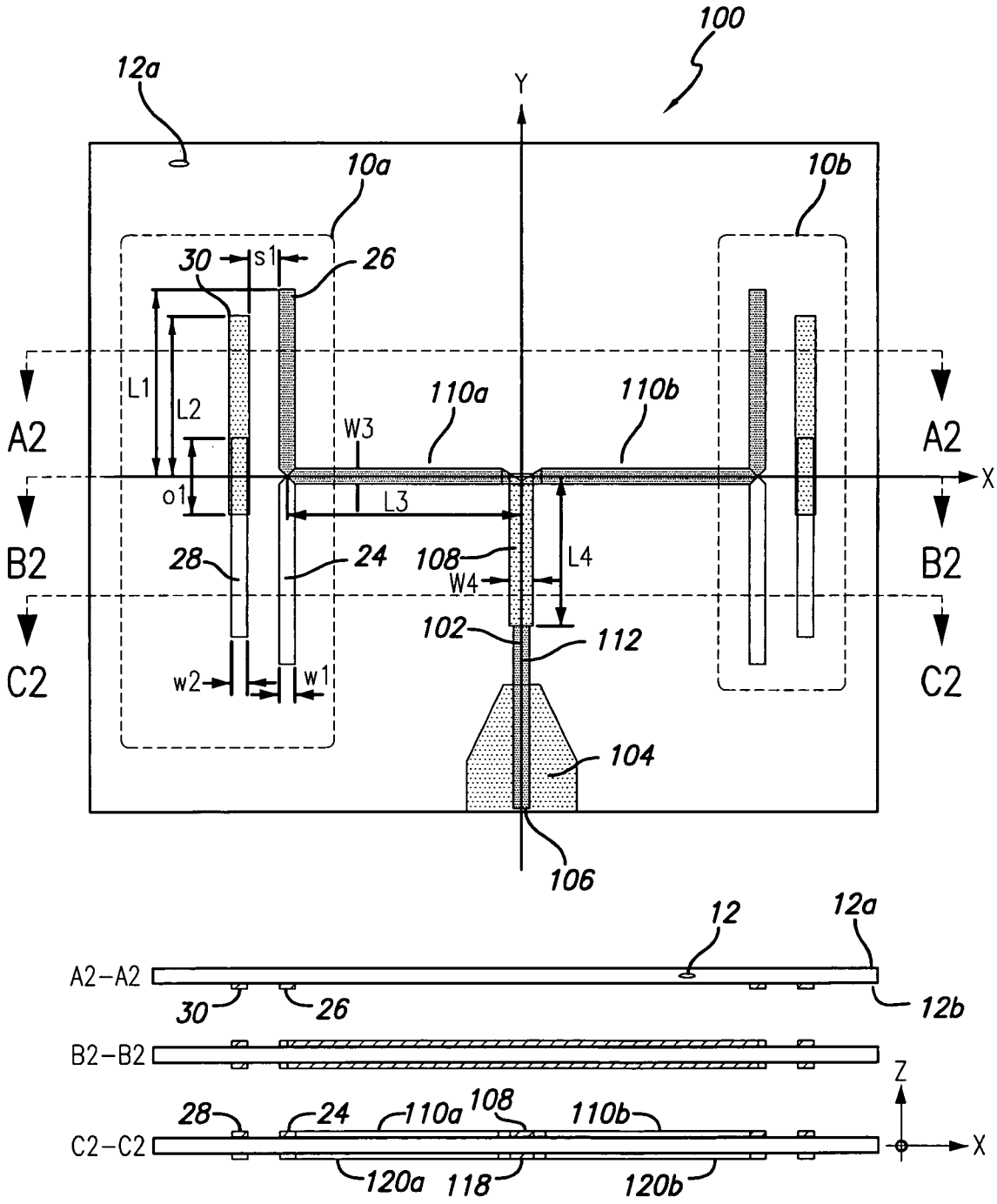
FIG. 1 is a top planar view and selected planar cross-sections of an omni-directional antenna element in accordance with the invention.

One object of the present invention is to provide dielectric based coplanar antenna elements which have broad frequency bandwidth and are easy to fabricate using conventional PCB processes. The present invention may preferably utilize a radiating element structure described in patent application Ser. No. 12/212,533 filed Sep. 17, 2008 and provisional patent application No. 60/994,557 filed Sep. 20, 2007, the disclosures of which are incorporated herein by reference in their entirety. In addition to coplanar radiating elements the present invention preferably takes advantage of pattern augmentation rods positioned in near proximity to the dielectric plane, equidistant to each surface side. To achieve an omni-directional radiation pattern a pair of symmetrically opposing radiating elements are preferably fed by a balanced feed network structure. The balanced feed structure provides equal signal division for each radiating element to achieve a symmetric radiation pattern. Additionally, a broad band balun is used to convert between a balanced feed network and an unbalanced, coaxial feed network.

In carrying out these and other objectives, features, and advantages of the present invention, a broad bandwidth antenna element is provided for use in a wireless network system.

Next a preferred embodiment of the present invention will be described. Reference will be made to the accompanying drawings, which assist in illustrating the various pertinent features of the present invention. In certain instances herein chosen for illustrating the invention, certain terminology is used which will be recognized as being employed for convenience and having no limiting significance. For example, the terms "horizontal", "vertical", "upper", "lower", "bottom" and "top" refer to the illustrated embodiment in its normal position of use. Some of the components represented in the drawings are not necessarily to scale, emphasis instead being placed upon clearly illustrating the principles of the present invention.

FIG. 1 shows a top (XY planar view) view of a coplanar omni-directional antenna element, 100, according to an exemplary implementation, which utilizes a substantially planar dielectric material 12. Additional antenna elements exterior of dielectric plate 12 are omitted from this figure for clarity and will be described later. Two broad bandwidth radiating elements 10*a* and 10*b* are disposed symmetrically on each side of dielectric material 12 about the Y axis. Construction of such radiating elements 10*a* and 10*b* employs a method which prints or attaches thin metal conductors directly on top 12*a* and bottom 12*b* sides of a dielectric substrate 12, such as a PCB (printed circuit board). The square dielectric plate 12 is dimensioned to fit all necessary conductors in a manner which is not only compact but which provides a desired radiation pattern, frequency response and bandwidth over the desired frequency. In an exemplary embodiment the desired radio frequency (RF) is approximately 3.30 GHz to 3.80 GHz while coplanar omni-directional antenna element, 100 is constructed utilizing commercially available PCB material manufactured by Taconic, specifically Taconic RF-35, with $\in_r$=3.5 and thickness=30 mills. Alternative dielectric substrates (PCB material) 12 are possible provided that properties of such substrate are chosen in a manner to be compatible with commonly available PCB processes; alternatively metal conductor attachment to the dielectric substrate can be achieved through various means known to the skilled in the art.

As shown, omni-directional antenna element 100 is provided with an upper dielectric 12*a* (12*b* is a lower side of a dielectric) side RF unbalanced input-output port 106. Input RF signals are further coupled over balun 104 structure (details are omitted). A balun is an electromagnetic structure for interfacing balanced impedance device or circuit, such as an antenna, with an unbalanced impedance, such as coaxial cable or microstrip line. In its common use a balanced signal comprises a pair of symmetrical signals, which are equal in magnitude and opposite in phase (180 degrees). In contrast, an unbalanced impedance may be characterized by a single conductor for supporting the propagation of unbalanced (i.e., asymmetrical) signals relative to a second conductor (i.e., ground). Numerous balun structures are known to those skilled in the art for converting the unbalanced to balanced signals and vice versa.

Thereafter, balanced RF signals are coupled onto 50 Ohm balanced impedance transmission line 102 (bottom side transmission line 112 is not visible) which is connected to 50 to 25 Ohm balanced ¼λ transformer comprising co-aligned bi-planar transmission lines 108, 118. Conventional implementation of a ¼λ transformer can readily utilize 35.3 Ohm characteristic impedance microstrip lines. Radiating elements' 10*a*, 10*b* characteristic load impedance is not the same as a conventional (73 Ohms) dipole known in the art. Instead, load impedance is a function of several variables such as parasitic coupling element spacing (30, 28) and mutual overlap o1, pattern augmentation rods 206, 208 positioning and diameter as well as several other variables to a lesser degree. Utilizing commercially available computer software (HFSS), radiating element 10*a* and 10*b* are optimized as a unit to provide an omni-directional radiation pattern as well as suitable load impedance (50 Ohms). Having 50 ohm load impedance greatly simplifies the feeding (110*a*-120*a* and 110*b*-120*b*) structure for each radiating element 10*a*, 10*b*. In a preferred implementation 50 Ohm balanced microstrip line (110*a*-120*a* and 110*b*-120*b*) pairs are used to feed respective radiating elements (10*a*, 10*b*) from the end of the ¼λ transformer 108, 118 from a common node (not labeled). The lengths of the 50 Ohm balanced microstrip line (110*a*-120*a* and 110*b*-120*b*) pairs also are optimized to provide an omni-directional pattern among other parameters. Alternative feed implementations are possible that may provide additional benefits or circuit simplification.

A detailed description of a preferred embodiment of radiating element 10 can be found in co-pending patent application Ser. No. 12/212,533 filed Sep. 17, 2008 and provisional patent application No. 60/994,557 filed Sep. 20, 2007 the disclosures of which are incorporated herein by reference in their entirety. This embodiment provides a broadband capability as described in the above applications. Alternative designs for radiating elements 10 can be employed, however, especially where broad bandwidth is not important and a variety of radiating element designs will be possible as known to those skilled in the art.

Figure 2:
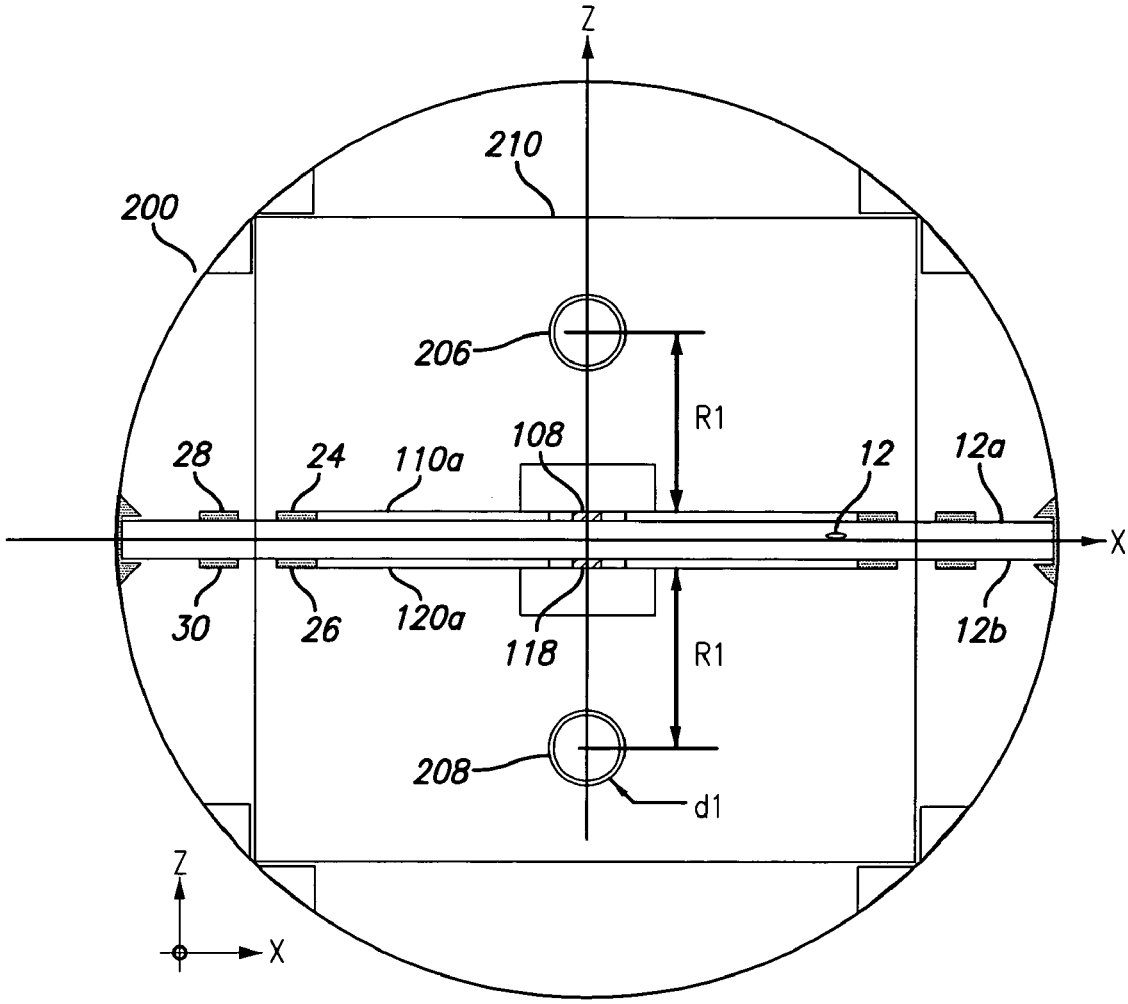
FIG. 2 is an XY cross sectional view of an antenna element in accordance with the invention utilizing a dual tube configuration, mounted inside a radome tube.

With reference to FIG. 2 a radome 200 with rod support(s) 210 is presented in addition to (along Y Axis) ZX planar view of dielectric plate 12. Rod support(s) 210 may be a suitable lightweight nonconductive material, for example such as Teflon or an RF transparent plastic. Supports 210 may have a planar shape as shown or other suitable shape to fit within radome 200. Proximate to, and running along longitudinal axis of the dielectric plate 12 are radiation pattern augmentation rods 206 and 208, positioned above and below top 12*a* and bottom 12*b* surface of dielectric plate 12 and attached to supports 210. The two radiation pattern augmentation rods 206 and 208 are symmetrical about the x-axis, and disposed equidistantly R1 from the surface of the dielectric 12. Preferably, the two radiation pattern augmentation rods 206 and 208 are constructed using conductive material, such as aluminum and the like. For additional weight and cost savings plastic rods with metallic surface treatment can be utilized, while metal based rods can utilize a thin wall metal tube or an extrusion instead of solid metal rod material. Therefore, the term rod as used herein covers all such variations and is not limited to a solid or a precisely cylindrical shape.

It will be appreciated by those skilled in the art that the conductive rods 206, 208 parasitically couple to the electromagnetic field of radiating elements 10*a*, 10*b* and have currents induced on their surface thereby becoming parasitic radiating elements. This provides an augmentation of the beam pattern from that of the elements 10 alone. More specifically, absent the radiation pattern augmentation rods 206 and 208 the beam pattern of radiating elements 10*a*, 10*b* would be bidirectional in nature, directed along the +/−x direction of FIG. 2. With the addition of the radiation pattern augmentation rods 206 and 208 the beam pattern becomes substantially omni-directional. Since the radiation pattern augmentation rods 206 and 208 operate as parasitic elements no feed network is required to supply the rods. Also, a ground plane is not necessary. As a result the omni-directional antenna can be light weight and inexpensive relative to other omni-directional antenna designs.

Figure 2A:
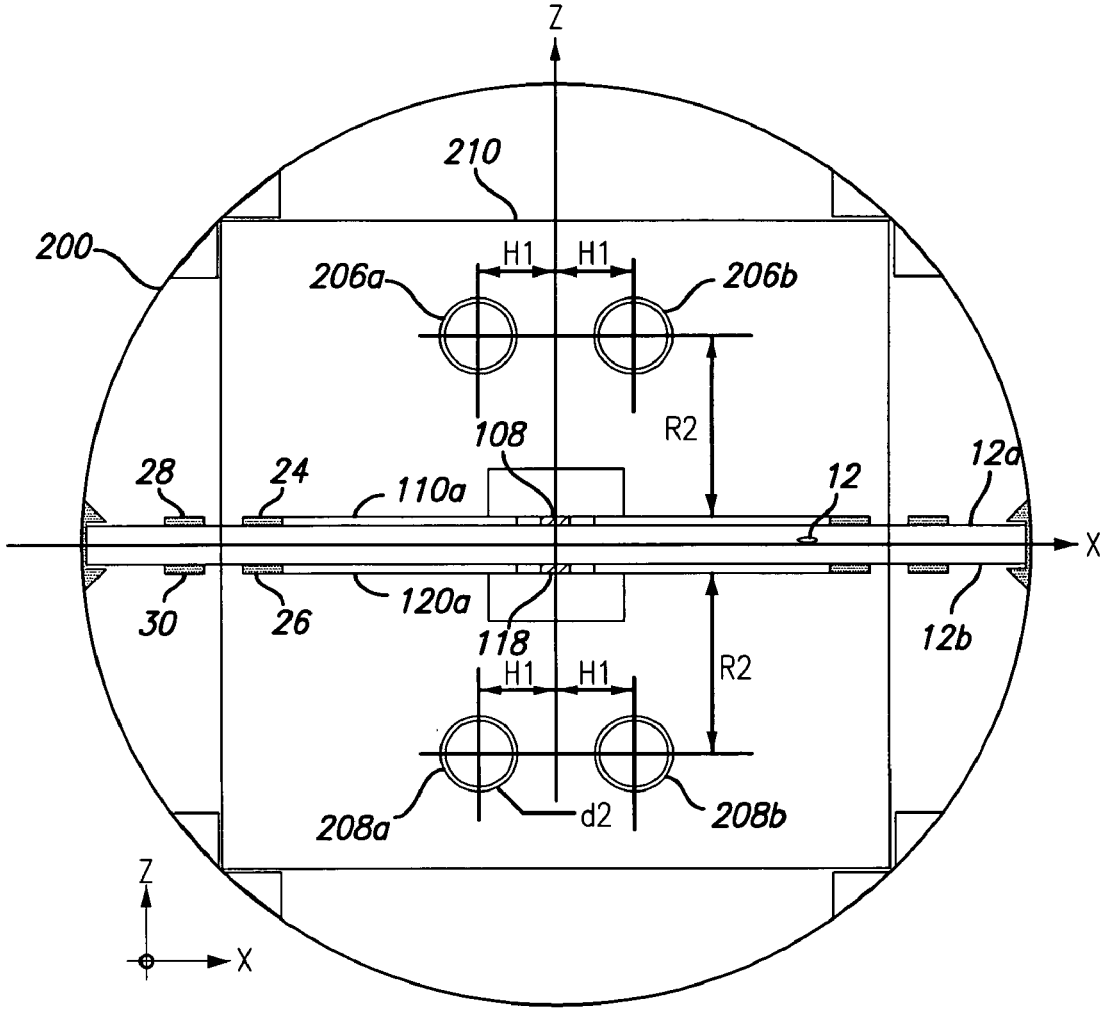
FIG. 2A is an XY cross sectional view of an antenna element in accordance with the invention utilizing a quad horizontal tube configuration, mounted inside a radome tube.
Figure 2B:
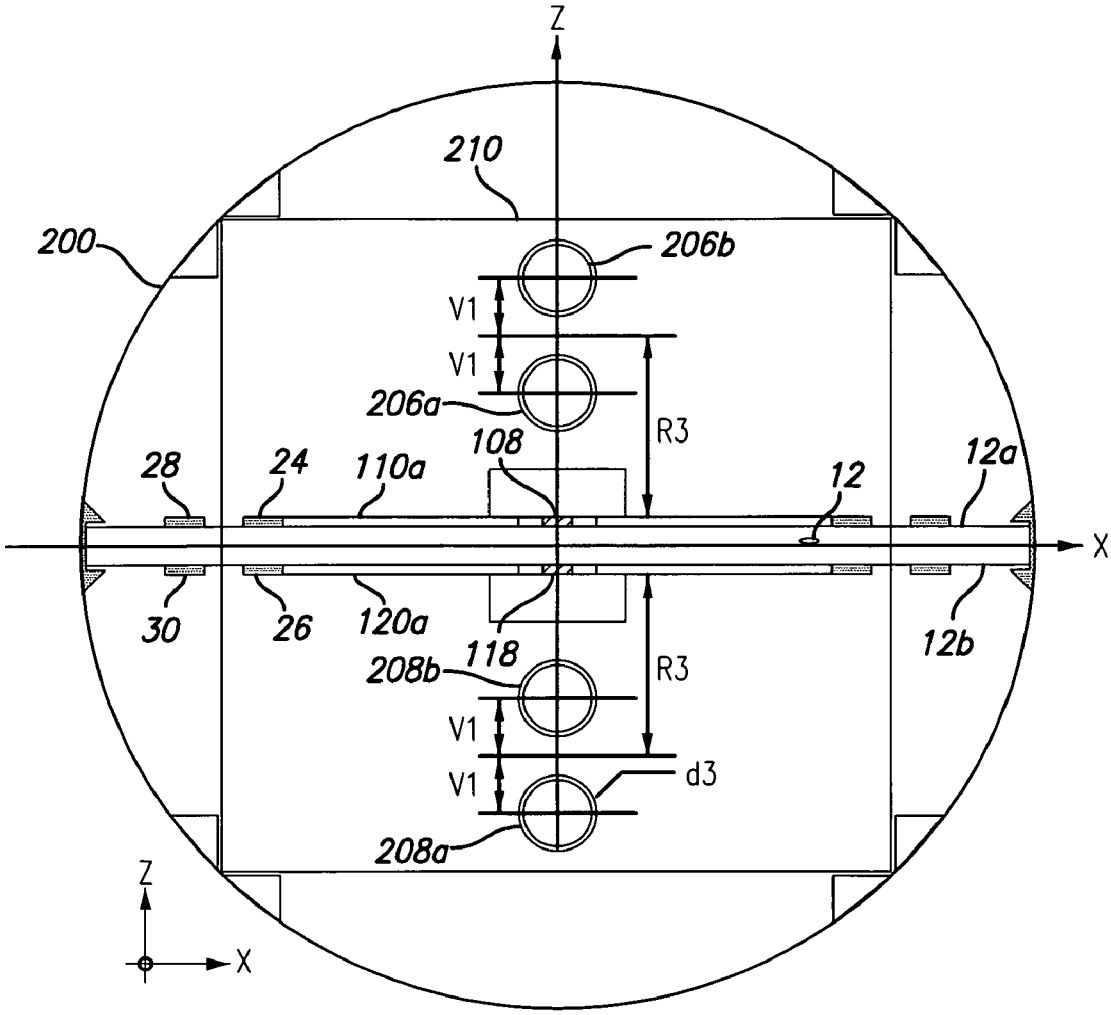
FIG. 2B is an XY cross sectional view of an antenna element in accordance with the invention utilizing a quad vertical tube configuration, mounted inside a radome tube.
Figure 3:
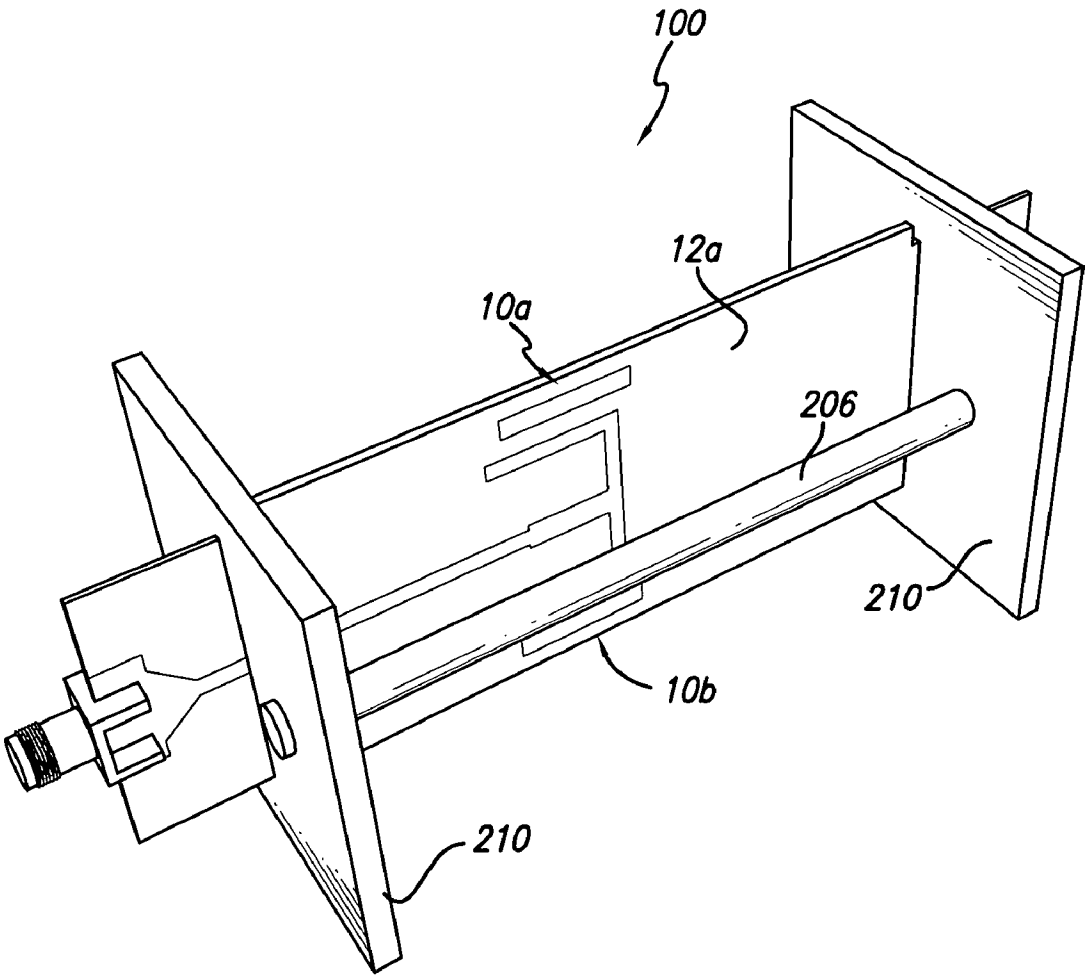
FIG. 3 is a left sided perspective view of an antenna element in accordance with the invention.
Figure 4:
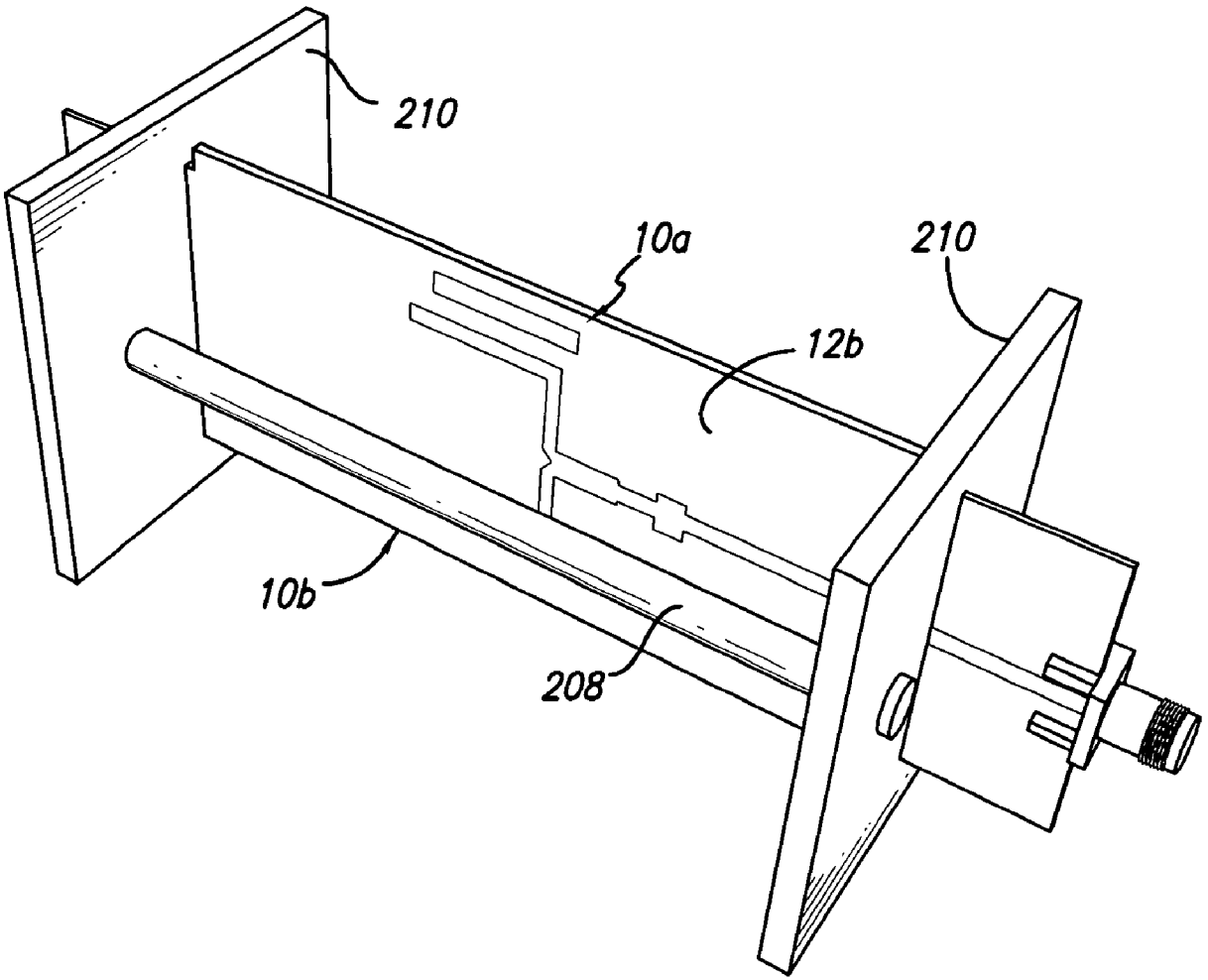
FIG. 4 is a right sided perspective view of an antenna element in accordance with the invention.
Figure 4A:
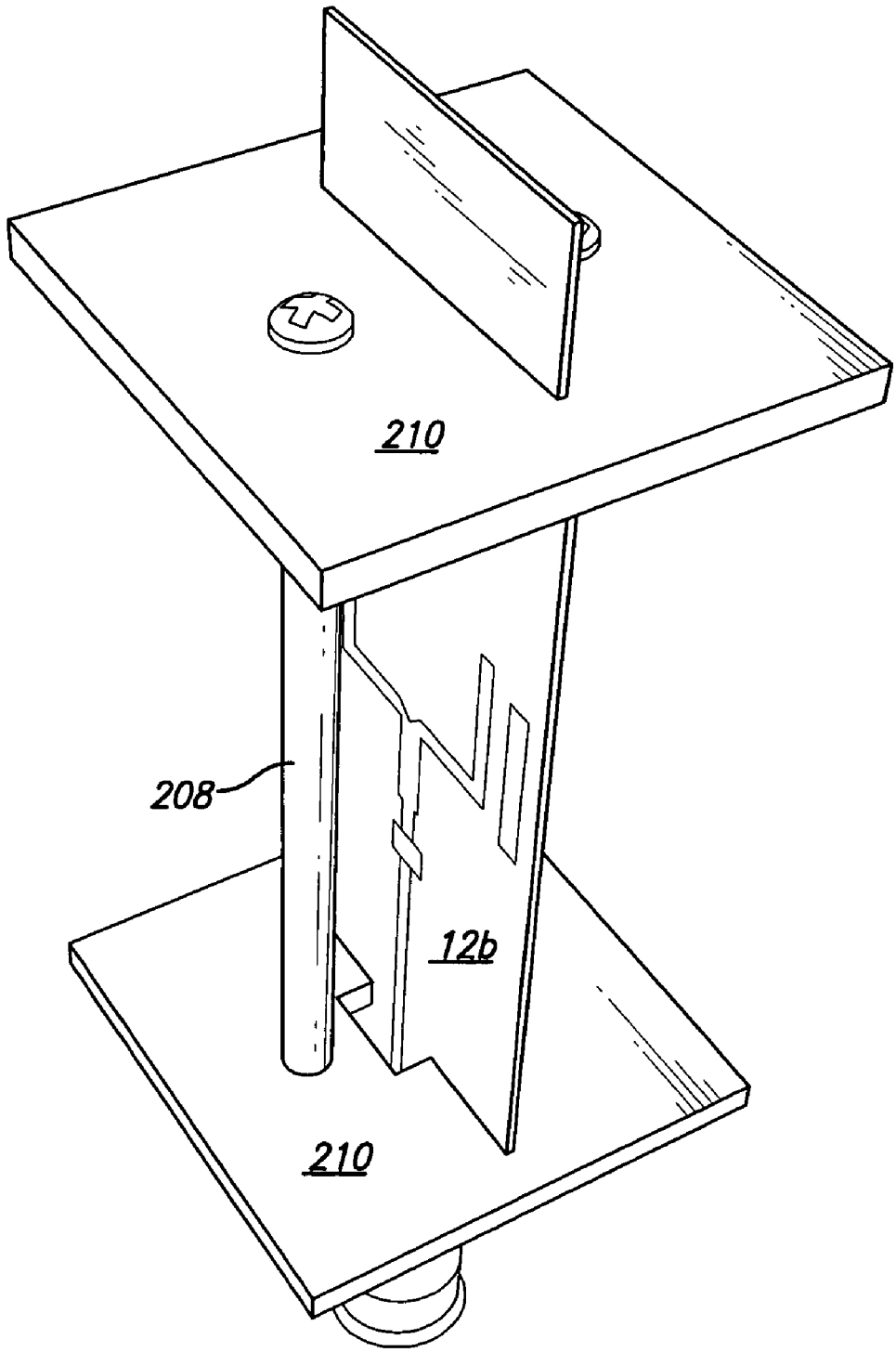
FIG. 4A is a vertically oriented perspective view of an antenna element in accordance with the invention.

Performance of the omni-directional antenna 100 element equipped with a pair of radiation pattern augmentation rods 206 and 208 can be further modified which may provide improved performance in some applications. A single rod can be replaced with pair of similarly constructed rods on each side of dielectric plate 12 to form a quad rod implementation. Quad rod implementations can be oriented horizontally (FIG. 2A) or vertically (FIG. 2B). It is also possible to replace a single pairing of rods (206*a, b* and 208*a, b*) with a single piece extrusion or the like and variations in shape may be provided from the rod or tube illustrated.

Preferred dimensions for a 3.30 GHz to 3.80 GHz embodiment with 50 impedance source 106 impedance are as follows.

| Element | Dimension | Min (mills) | Max (mills) | Typical (mills) |
|---|---|---|---|---|
| 24, 26 | W1 | 86 | 90 | 88 |
| 24, 26 | L1 | 66 | 67 | 66.4 |
| 28, 30 | W2 | 105 | 120 | 112 |
| 28, 30 | L2 | 570 | 580 | 576 |
| 30 <-> 26 | s1 | 90 | 94 | 92 |

-continued

| Element | Dimension | Min (mills) | Max (mills) | Typical (mills) |
|---|---|---|---|---|
| 28 <-> 30 | O1 | 252 | 264 | 258 |
| 110, 120 | W3 | 86 | 90 | 88 |
| 110, 120 | L3 | 540 | 550 | 544 |
| 108, 118 | W4 | 135 | 139 | 137 |
| 108, 118 | L4 | 475 | 485 | 480 |
| 206, 208 | R1 | 400 | 540 | 440 |
| 206, 208 | d1 | 150 | 200 | 190 |
| 206a-b, 208a-b | R2 | 460 | 560 | 520 |
| 206a-b, 208a-b | H1 | 190 | 240 | 200 |
| 206a-b, 208a-b | d2 | 150 | 200 | 190 |
| 206a-b, 208a-b | R3 | 340 | 400 | 360 |
| 206a-b, 208a-b | V1 | 80 | 140 | 100 |
| 206a-b, 208a-b | d3 | 60 | 120 | 100 |

Figure 5:
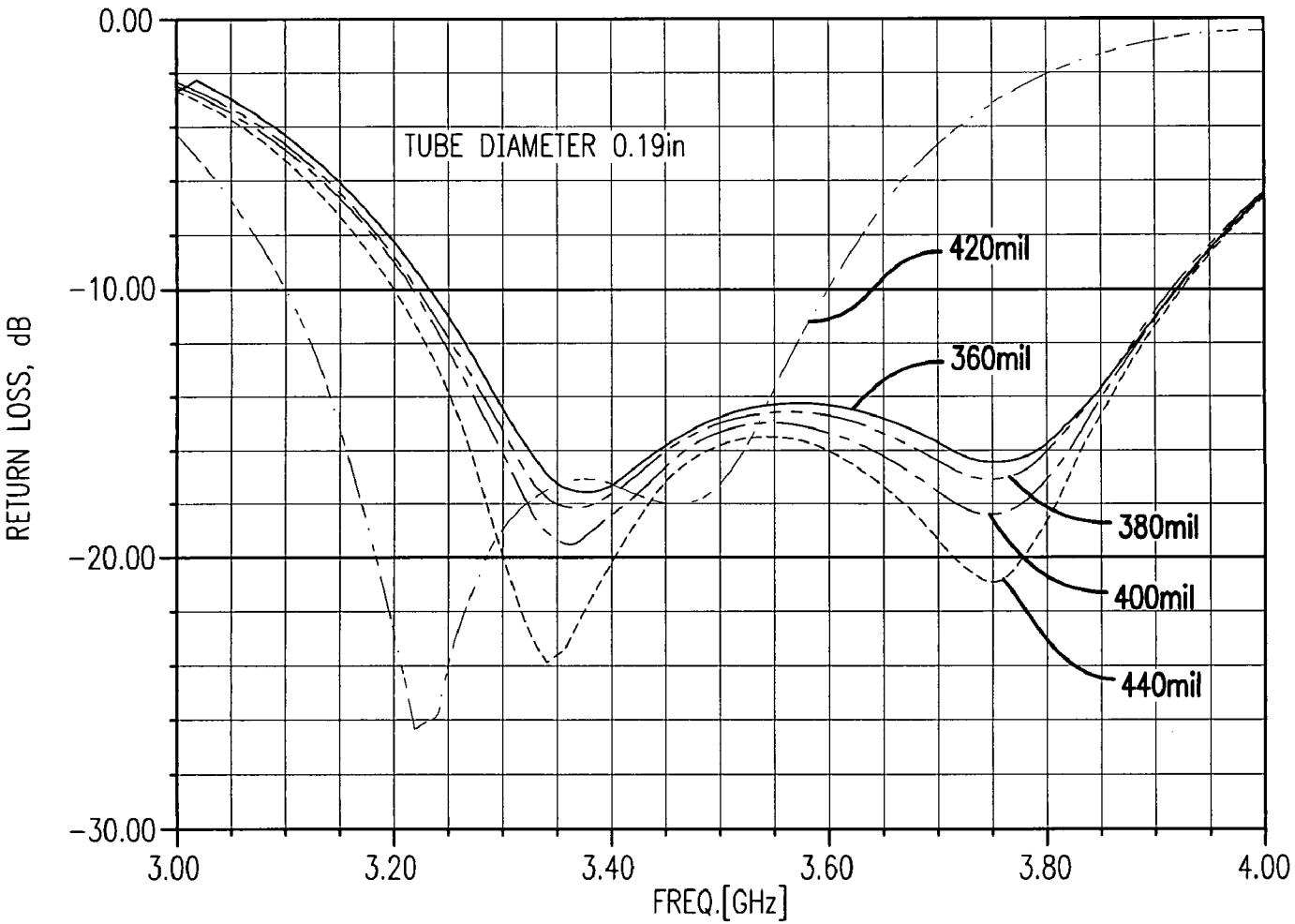
FIG. 5 is a graph showing input return loss for a dual 190 mil tube configuration, as a function of spacing (R1 range 360 to 440 mil) from the dielectric plane surface.
Figure 6:
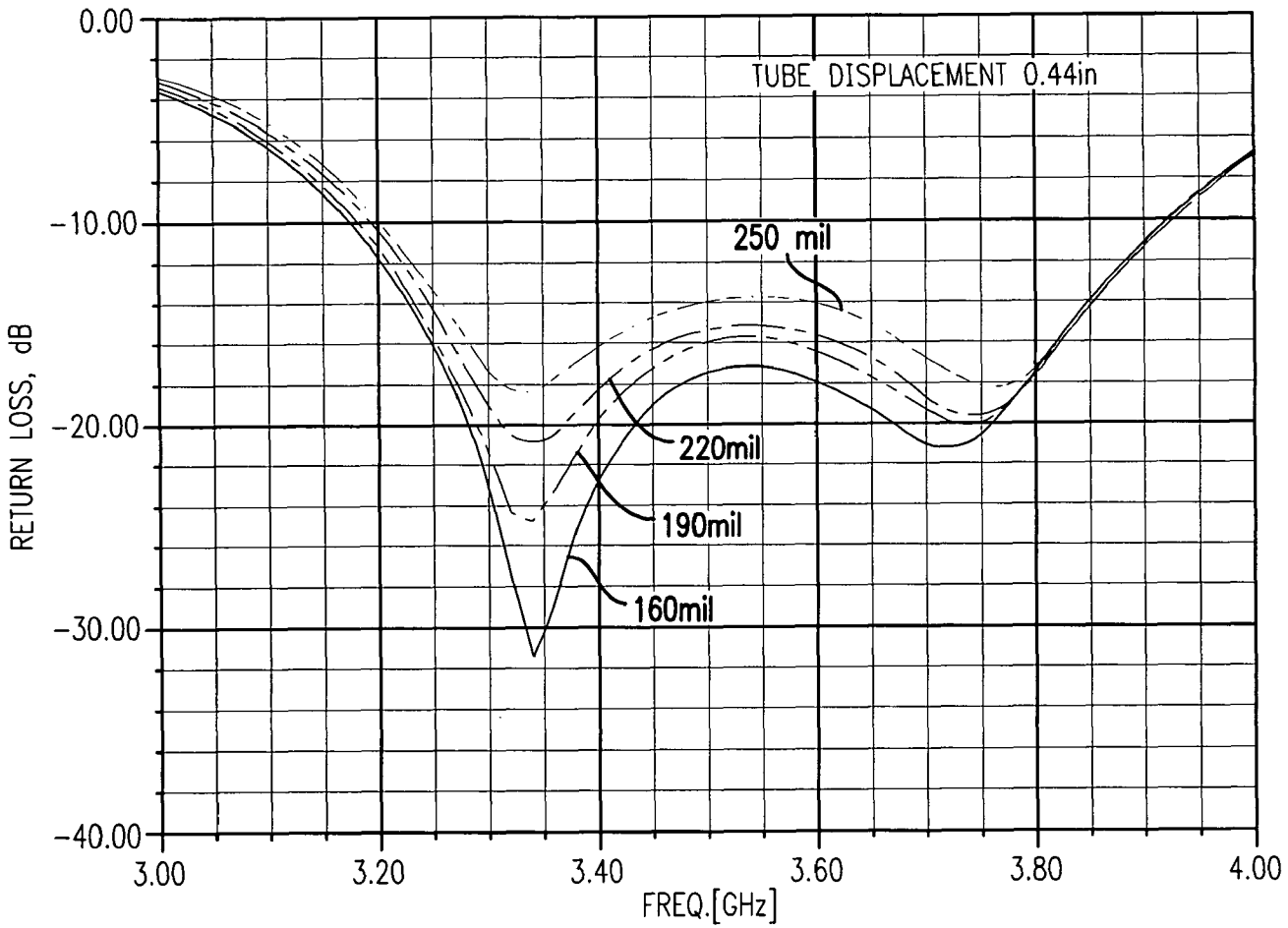
FIG. 6 is a graph showing input return loss for a dual tube configuration, as a function of tube diameter (160 to 250 mil) placed R1=440 mils from the surface of the dielectric plane.
Figure 7:
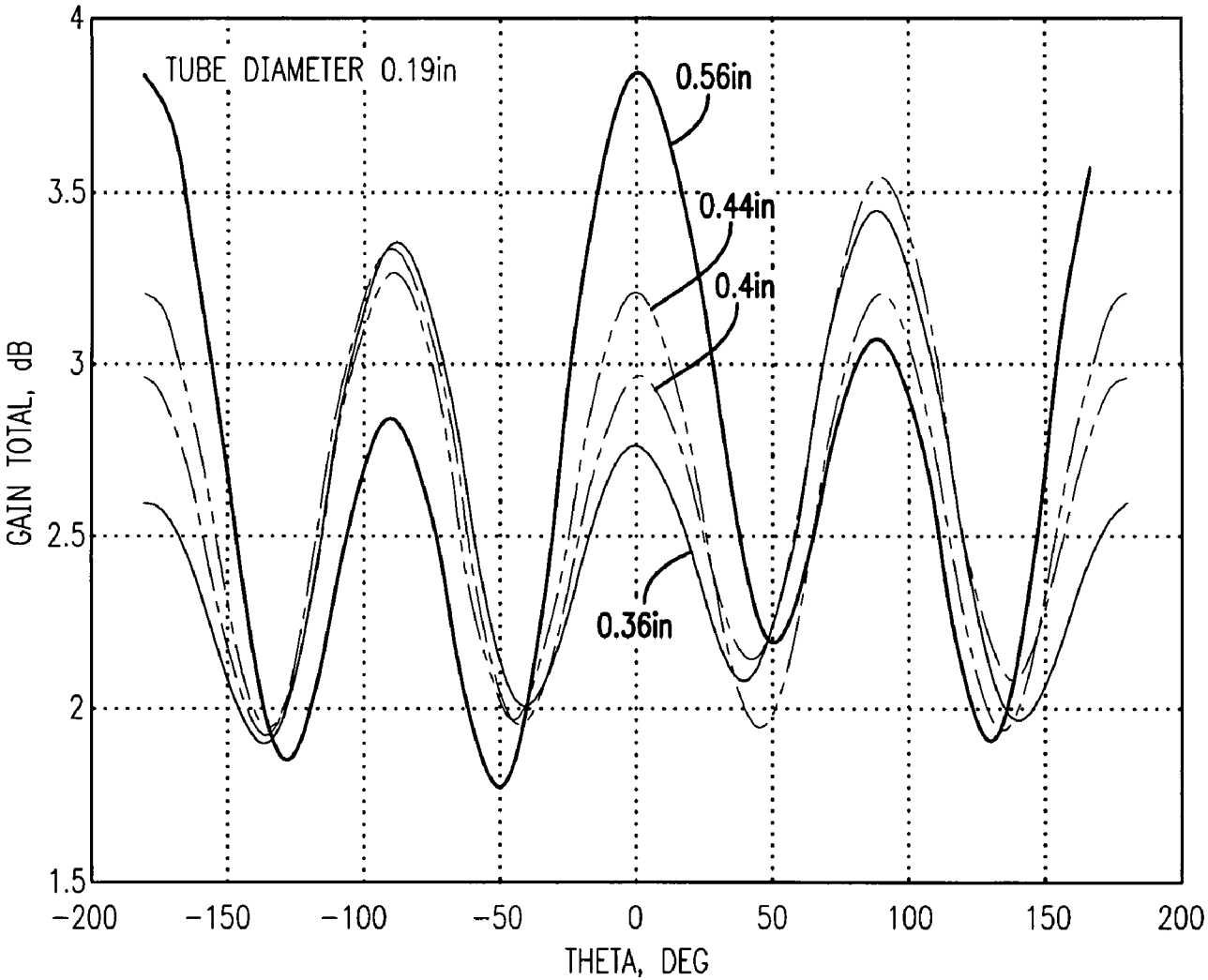
FIG. 7 is a graph showing azimuth gain ripple as a function of a dual (190 mil) tube placement (R1=360 to 560 mils) above the surface of the dielectric plane.

Results employing exemplary parameters were obtained. FIG. 5 is a graph showing input return loss for a dual 190 mil tube configuration, as a function of spacing (R1 range 360 to 440 mil) from the dielectric plane surface. FIG. 6 is a graph showing input return loss for a dual tube configuration, as a function of tube diameter (160 to 250 mil) placed R1=440 mils from the surface of the dielectric plane. FIG. 7 is a graph showing azimuth gain ripple as a function of a dual (190 mil) tube placement (R1=360 to 560 mils) above the surface of the dielectric plane.

The present invention has been described primarily in solving the aforementioned problems relating to expanding useful frequency bandwidth of a coplanar antenna element while providing a nearly uniform omni-directional radiation pattern. Furthermore, the description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An omni-directional antenna, comprising:

a first radiating element and a second radiating element oriented in generally opposite directions;

a first parasitic radiating element configured between said first and second radiating elements and spaced apart therefrom in a first direction;

a second parasitic radiating element configured between said first and second radiating elements and spaced apart therefrom in a second direction generally opposite to said first direction; and a generally planar dielectric support structure;

wherein said first radiating element and second radiating element are planar dipole radiating elements configured on said planar dielectric support structure; and wherein said first and second parasitic radiating elements are configured on opposite sides of said dielectric support structure and spaced apart therefrom.

2. An omni-directional antenna as set out in claim 1, wherein said first and second parasitic radiating elements are spaced an equidistance from respective opposite sides of said dielectric support structure.

3. An omni-directional antenna as set out in claim 1, wherein said first and second parasitic radiating elements comprise elongated conductive rods.

4. An omni-directional antenna as set out in claim 1, further comprising third and fourth parasitic radiating elements configured between said first and second radiating elements and spaced apart therefrom in said first and second directions respectively.

5. An omni-directional antenna as set out in claim 4, wherein said first, second, third and fourth parasitic radiating elements comprise generally parallel elongated conductive rods.

6. An omni-directional antenna as set out in claim 5, wherein in a coordinate system defined such that said first and second directions correspond to opposite directions along a z axis, the first radiating element and second radiating element are oriented in opposite directions along an x axis, and a y axis is defined perpendicular to the x z plane, said generally parallel elongated conductive rods have a length dimension extending in the y direction.

7. An omni-directional antenna as set out in claim 6, wherein said first and third and second and fourth parasitic radiating elements are aligned along said z direction and symmetrically configured on opposite sides of said x axis.

8. An omni-directional antenna as set out in claim 6, wherein said first and third and second and fourth parasitic radiating elements are respectively aligned along directions parallel to said x axis and symmetrically configured on opposite sides of said x axis.

* * * * *